United States Patent [19]

Yavorsky

[11] Patent Number: 4,817,830

[45] Date of Patent: Apr. 4, 1989

[54] PRESSURE VESSEL WITH A BLADDER

[75] Inventor: William M. Yavorsky, Woodbury, Minn.

[73] Assignee: Ecodyne Corporation, St. Paul, Minn.

[21] Appl. No.: 925,609

[22] Filed: Oct. 31, 1986

[51] Int. Cl.[4] ..... B67D 5/42

[52] U.S. Cl. ..... 222/386.5; 220/465

[58] Field of Search ..... 220/3, 400, 465; 222/386, 386.5, 94, 212

[56] References Cited

U.S. PATENT DOCUMENTS

| | | | |
|---|---|---|---|
| 1,471,091 | 10/1923 | Bessesen | 222/386.5 |
| 2,513,455 | 7/1950 | Cornelius | 222/386.5 |
| 3,300,102 | 1/1967 | Budzich | 222/386.5 |
| 3,917,117 | 11/1975 | Plotsky | 222/94 |
| 4,265,373 | 5/1981 | Stoody | 222/94 |
| 4,360,116 | 11/1982 | Humphrey | 220/3 |
| 4,458,830 | 7/1984 | Werding | 222/212 X |
| 4,537,329 | 8/1985 | Norton | 220/465 |
| 4,712,711 | 12/1987 | Geering et al. | 220/457 |

OTHER PUBLICATIONS

*It's the Revolutionary New Duracel, by Structural Fibers,* Structural Fibers: Industrial Parkway, Chardon, Ohio 44024.

*Introducing Perma-Pac a New Generation Delivery System,* Park International Corp., 1401 Freeman Ave., Long Beach, Calif. 90804.

*Primary Examiner*—Michael S. Huppert

*Attorney, Agent, or Firm*—Neuman, Williams, Anderson & Olson

[57] ABSTRACT

An improved thin-walled pressure vessel having a bladder is provided. This vessel includes a shell having an opening and a spout disposed around the opening. An improved cap normally closes this opening, secures the bladder to the shell of the vessel, and provides communication between the outside of the vessel and the inside of the bladder. The cap member comprises a main body member having an opening which receives a valve member. This valve member extends out through one end of the cap member. It also extends through the opposite end of the cap and into the bladder through an opening in the bladder. The valve member engages a portion of the bladder around the opening and clamps this portion against the main body member to secure the bladder to the cap member. As the pressure in the bladder increases, it forces the valve member further against the walls of the opening in the main body member, increasing the clamping force to firmly secure the bladder to the cap member.

4 Claims, 1 Drawing Sheet

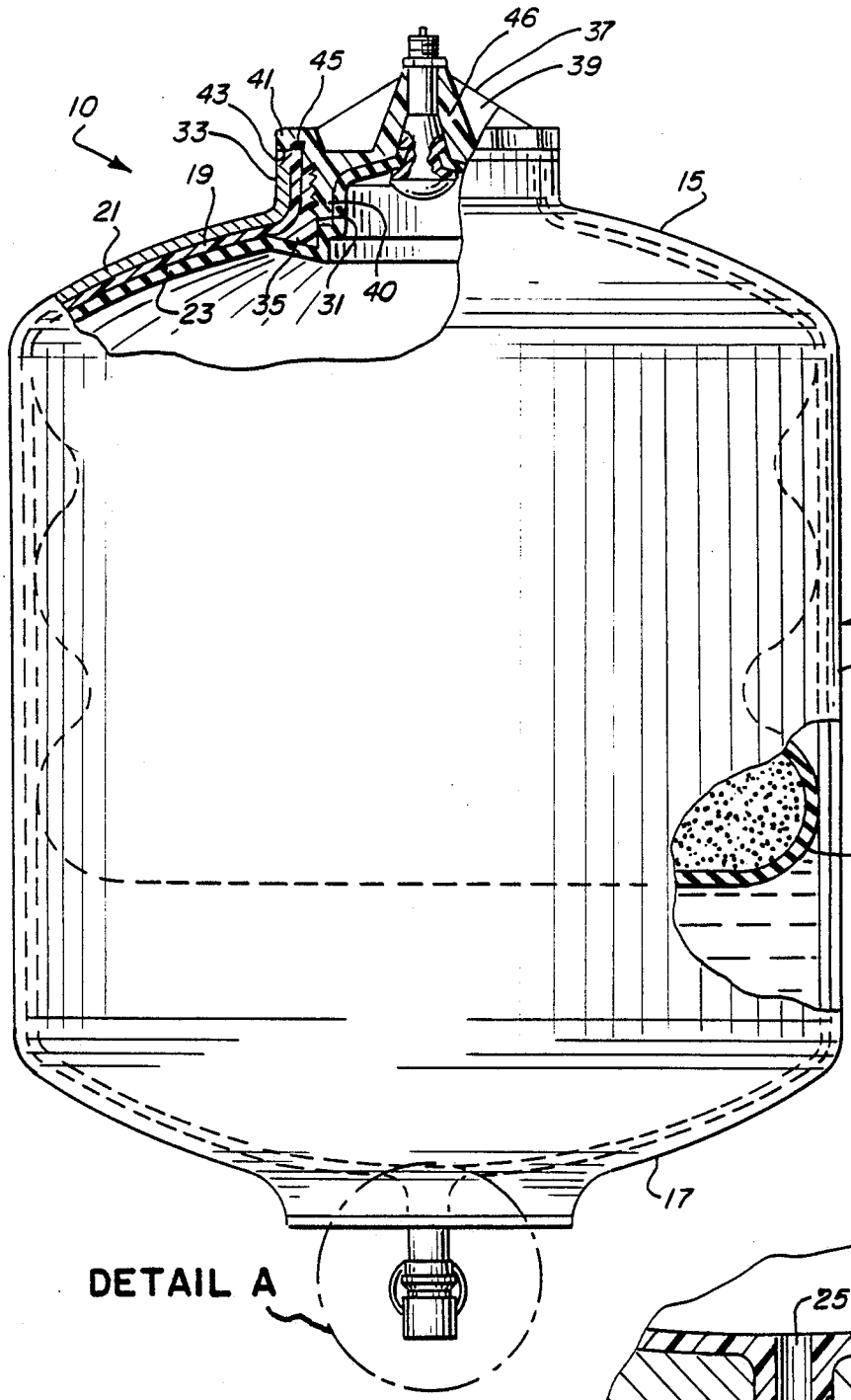
FIG. 1
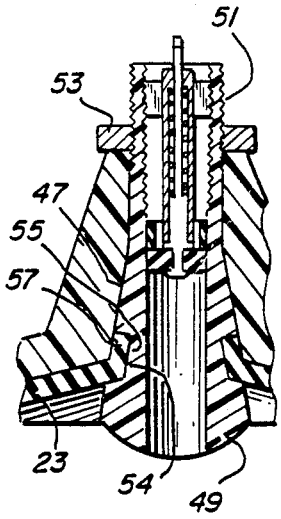
FIG. 2
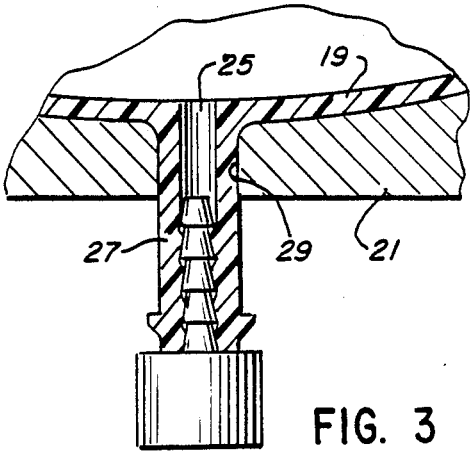
FIG. 3
FIG. 4
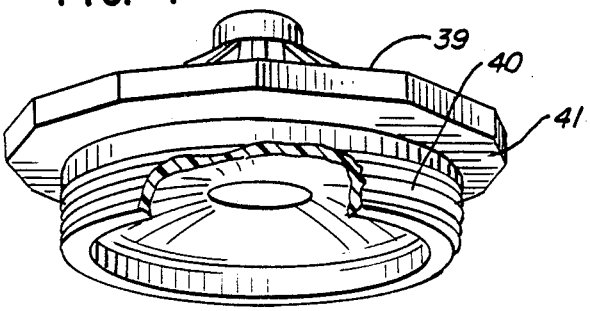

PRESSURE VESSEL WITH A BLADDER

BACKGROUND OF THE INVENTION

1. Field Of The Invention

The present invention relates to a pressure vessel having an elastic bladder for evacuating the fluids contained inside the vessel. More particularly, the invention relates to a cap which secures the bladder of a pressure vessel to a spout or neck portion disposed around an opening in the vessel. This cap also allows access to the bladder so that the user may inflate the bladder and evacuate the vessel.

2. Description Of The Prior Art

The prior art includes many pressure vessels which have a bladder disposed in the chamber defined by the vessel. In some of these prior vessels the bladder acts as a liner and receives the fluids which the vessel contains. In other prior pressure vessels the bladder forces the fluids which the vessel contains out of the vessel as the user fills the bladder with a second fluid, normally a gas.

These prior art pressure vessels include various structural components which secure the bladder to the shell of the vessel so that the user of the vessel may have access to the bladder and which provide communication between the outside of the vessel and the bladder. These prior vessels, however, suffer a number of disadvantages. First, the components used to secure the bladder require that the pressure vessel have a substantially increased thickness at the location where they secure the bladder to the vessel. Additionally, the structural components are massive and include a multiplicity of close tolerance components which are costly and difficult to assemble. Finally, they do not fasten the bladder securely; and they do not provide leak-proof communication with the bladder.

The pressure vessel of the present invention provides a structure which overcomes the disadvantages and complexities of the prior art. It includes a bladder with a securing structure which has a small number of components with sufficiently accurate and consistent tolerances to provide leak-proof communication between the outside of the vessel and the inside of the bladder. This structure also provides the requisite clamping action to effectively secure the bladder to the shell of the vessel.

The pressure vessel of the present invention comprises a shell made of a thermoplastic inner liner and a filament wound outer layer. This shell has an opening, and a sleeve portion or spout disposed circumjacent this opening. The cap which closes this opening secures a bladder disposed inside the vessel to the spout and allows access to the inside of the bladder so that the user may fill the bladder with a fluid, namely a gas such as air. As the bladder expands, it displaces the liquid fluid which the vessel contains and forces it out of the vessel through a port.

SUMMARY OF THE INVENTION

It is a general object of the present invention to provide an improved pressure vessel.

It is another object of this invention to provide an improved pressure vessel that overcomes the disadvantages and complexities of the prior art.

It is a further object of the present invention to provide a pressure vessel which includes a bladder for evacuating the fluids contained in the vessel and an improved cap member for securing the bladder to the shell of the vessel and allowing easy inflation of the bladder.

It is another object of this invention to provide a pressure vessel which includes a bladder and a cap comprising components with sufficiently accurate and consistent tolerances to firmly secure the bladder to the shell of the vessel and to allow the user to easily inflate the bladder.

Other objects, advantages and features of the present invention will become apparent upon reading the following detailed description and appended claims and upon reference to the accompanying drawings.

In the preferred embodiment of the present invention, a pressure vessel for containing fluids has an improved cap member which secures a bladder disposed in the pressure vessel and which provides leak-proof communication between the outside of the vessel and the inside of the bladder. The vessel comprises a hollow shell including an inner liner made of a suitable thermoplastic material and an outer layer or shell which covers the inner liner and provides strength, rigidity and structural integrity to the vessel. The outer shell comprises a layer of glass filaments bound by a resinous material to each other.

In the preferred embodiment, the hollow shell has an opening and a sleeve portion or spout around the opening. This spout projects outwardly of the pressure vessel. Its inner surface includes a threaded portion which engages a corresponding threaded portion of a cap which normally closes the opening.

The cap which closes the opening in the vessel includes a main body member having an opening through its center and a valve member disposed in the opening. The main body member is made from a hard plastic material with high strength and rigidity. The center of the main body member has an increased thickness. Consequently, the opening through this area is elongate, and it has a generally frustoconical shape. As means for securing the cap to the sleeve portion of the shell, the main body member includes a threaded portion which engages a corresponding threaded portion of the sleeve portion. This connection and a washer disposed in compression between the cap and the spout provide a leak-proof seal between the cap and the shell of the vessel.

The valve member is a conventional air pressure valve. Its shape corresponds to the shape of the opening through the main body member in which it lies. One end of the valve extends out of the vessel where the user may connect it to a suitable gas supply. A nut threaded around this end secures the valve member in place in the opening of the main body member. The other end of the valve member extends into a bladder disposed in the pressure vessel through an opening in the bladder. The mid-section of the valve member includes a recess which receives the portion of the bladder around the opening through which the valve member extends into the bladder. The valve member clamps this portion of the bladder between itself and the walls of the opening in the main body member and secures the bladder to the cap and accordingly, to the shell of the vessel.

When the user injects a gas in the bladder through the valve, the pressure in the bladder increases. This pressure forces the valve member to move farther into the opening of the cap member, increasing the clamping pressure against the portion of the bladder which it secures. This feature, provides sufficient clamping pressure to firmly secure the bladder to the shell of the vessel. It, in addition to the substantial length of the opening through the cap, also provides a leak-proof seal between the walls of the valve member and the walls of the opening through the cap.

The bladder is made out of a flexible synthetic rubber or any other suitable material. Fully inflated, it has the shape of the shell, and it completely fills the chamber of the vessel. As it expands, the bladder displaces the liquid fluid which the vessel contains, forcing the fluid out of the vessel through a port in the shell.

BRIEF DESCRIPTION OF THE DRAWINGS

For a more complete understanding of this invention, one should now refer to the embodiment illustrated in greater detail in the accompanying drawings and described below by way of an example of the invention. In the drawings:

FIG. 1 is a side elevation view of a pressure vessel of the present invention with portions broken away.

FIG. 2 is a sectional view of the middle portion of the cap of the present invention.

FIG. 3 is an enlarged view of detail A in FIG. 1.

FIG. 4 is a perspective view of the main body member of the cap.

While the following text describes the invention in connection with a preferred embodiment, one should understand that the invention is not limited to this embodiment. Furthermore, one should understand that the drawings are not necessarily to scale.

DETAILED DESCRIPTION OF THE DRAWINGS AND THE PREFERRED EMBODIMENT

Turning now to the drawings, FIG. 1 shows a pressure vessel generally at 10. The vessel 10 is a cylindrical tank capable of containing various fluids, normally liquids. It comprises a hollow shell 11 having an elongate cylindrical body 13 and domed top and bottom portions, 15 and 17, respectively. The hollow shell 11 includes an inner liner 19 made of a suitable thermoplastic material such as polyethylene or any other high strength, impervious material. The inner liner 19 is the inside layer of the shell 11, and it has the same general shape as the outside surface of the vessel as described above.

In addition to the inner layer 19, the shell 11 includes an outer layer 21 which covers the inner lining 19 and provides strength, rigidity and structural integrity to the vessel. This outer layer comprises glass filaments bound by a resinous material to each other and to the lining 11. Together, the inner liner 19 and outer layer 21 form a thin-walled, light-weight shell.

The vessel 10 also includes a bladder 23 disposed in the shell 11. Preferably, this bladder 23 is made from thermoplastic material like the material of the inner liner; and the manufacturer blow molds the bladder along with the inner liner. Alternatively, the bladder may be made from an elastic material such as synthetic rubber or any other suitable material. Fully inflated, the bladder assumes the shape of the shell, and it completely fills the chamber of the vessel. By inflating it, the user can evacuate the shell 11 of any fluid because as the bladder expands it displaces the fluid, usually a liquid, and forces it out of the vessel.

To provide access to its chamber, the shell 11 includes a port 25 through the domed bottom portion 17. (See FIG. 3). The port 25 extends through a spout 27 which is a portion of the inner liner 19 and which projects outward of the liner 19 through an opening 29 of the outer layer 21. The user may fill and evacuate the vessel 10 through this port.

To provide access to the bladder 23, the shell 11 includes a port 31 through the top domed portion 15. The inner layer 19 and the outer layer 21 of the shell 11 project outward of the vessel to form a cylindrical spout 33 around the opening. This spout 33 also includes a sleeve 35 disposed circumjacent the port 31 and bonded to the inner layer 19 of the spout 33. The sleeve 35 is made from a hard plastic with high strength and rigidity. Its inner surface has threading formed into it for receiving a cap 37 which normally closes the port 31.

The cap 37 includes a main body member 39 having a generally circular shape with a rim which comprises a threaded portion 40 and a flange 41. The threaded portion 40 engages the corresponding threaded portion of the sleeve 35 to secure the cap over the port 31. The flange 41 overlies the outer rim 43 of the spout 33 and compresses a flexible o-ring washer 45 disposed between the flange 41 and the rim 43. This washer 45 and the threaded connection between the spout 33 and the cap 37 provide a leak-proof seal between the cap and the shell 11.

In addition, the main body member 39 has a wide center portion 46 and an opening 47 through this center portion. This opening 47 has a generally frustoconical shape; and it receives a valve member 49 having an outer shape corresponding to that of the opening. Since the center portion through which the opening 47 extends has an increased width, the opening 47 has a substantial length. In addition, the valve member 49 lies in this opening 47 in pressure contact with the walls of the opening. (See discussion in the following text). These features provide a leak-proof seal between the cap 37 and the valve member 49.

This valve member is a conventional air pressure valve, and it extends through the opening 47 at both ends, closing the opening. At one end, the end which extends through the outer surface of the cap 37, it includes a threaded portion 51 which a nut 53 engages to secure the valve to the cap member so that it does not fall back into the bladder. At the opposite end, the valve member 49 extends into the bladder 23 through a round opening 54 in the bladder. A recess 55 formed around the sides of the valve member 49 receives the portion 57 of the bladder circumjacent this opening. When placed in the position shown in FIG. 2, the valve member 49 clamps the bladder portion 57 to the main body member 39, securing the bladder 23 to the cap 37.

As the user of the vessel 10 inflates the bladder and the gas pressure in the bladder 23 increases, it forces the valve member 49 outward of the vessel 10, increasing the clamping force on the portion 57 of the bladder. Additionally, as the bladder expands, it displaces the fluid which the vessel contains, forcing the fluid out of the vessel through the port 25. Fully inflated, the bladder 23 assumes the shape of the shell 11, fills the shell completely, and evacuates all of the fluid from the vessel.

Thus, the applicant has provided an improved vessel having a bladder for evacuating the vessel and a cap for securing the bladder to the walls of the vessel and allowing leak-proof communication between the outside of the vessel and the inside of the bladder. The cap is a simple structural component having a body member with an opening which receives a valve member for securing the bladder to a cap and providing access to the bladder. As the pressure of the fluid in the bladder increases, it forces the valve member against the side walls of the frustoconical opening, thus providing greater clamping pressure to hold the bladder against the cap.

While the applicant has shown only one embodiment of the invention, one will understand of course that the invention is not limited to this embodiment since those skilled in the art to which the invention pertains may make modification and other embodiments of the principles of this invention, particularly upon considering the foregoing teachings. For example, the opening through the main body member of the cap may have different configurations than that shown. In addition, the port which the cap closes may have any one of a number of configurations and any suitable means may secure the cap to the shell. The applicant, therefore, by the appended claims, intends to cover any such modifications and embodiments as incorporate those features which constitute the essential features of this invention.

What is claimed is:

1. A pressure vessel for containing fluids, said pressure vessel comprising: a thin thermoplastic inner liner providing an impervious barrier to said fluids, said inner liner having an opening therethrough; an outer layer covering said inner liner and providing strength, rigidity and structural integrity to said vessel, said outer layer having an opening substantially coincident with said opening of said inner liner; said opening in said inner liner and said opening in said outer layer forming a port through said vessel; an elastic, inflatable bladder disposed in said inner liner and suspended within said fluids for displacing said fluids out of the vessel; and cap means normally closing said port, said cap means comprising a rigid main body member having an opening therethrough and valve means positioned in said opening of said main body member for closing said opening in said main body member, securing means for securing said cap means in leak-proof engagement over said port, said bladder having an opening and said valve means including a recess for receiving a portion of said bladder disposed around said opening in said bladder, said valve means clamping said portion of said bladder against the walls of said opening through said main body member of said cap means, suspending said bladder from said main body member, and providing communication with said bladder.

2. The pressure vessel of claim 1, wherein said opening through said main body member of said cap means has a generally frustoconical shape and said valve means has a corresponding frustoconical shape so that any force on said valve means in one direction causes said valve means to provide a greater clamping force.

3. A pressure vessel for containing fluids, said pressure vessel comprising: a thin thermoplastic inner liner providing an impervious barrier to said fluids and having first and second end portions and a substantially cylindrical middle portion connected to said end portions, said inner liner having an opening through said first end portion and including a sleeve portion disposed around said opening and projecting outward of said vessel; an outer layer substantially covering said inner liner and having an opening substantially coincident with said opening of said inner liner and including a sleeve portions substantially covering said sleeve portion of said inner liner; an elastic, inflatable bladder disposed in said inner liner and suspended in said fluids for displacing said fluids out of the vessel; said sleeve portion of said inner liner and said outer layer forming a spout; cap means engaging said spout and normally closing said opening in said inner liner and outer layer, said cap means comprising: a rigid main body member having an opening therethrough and valve means positioned in said opening of said main body member for closing said opening of said main body member, said valve means securing said bladder to said main body member, suspending said bladder from said main body member, and providing communication with said bladder; and securing means for securing said cap means in leak-proof engagement with said spout.

4. The pressure vessel of claim 3, wherein said opening through said main body member of said cap means has a generally frustoconical shape and said valve means has a corresponding frustoconical shape so that any force on said valve means in one direction causes said valve means to provide a greater clamping force.

* * * * *